US006279339B1

(12) United States Patent
Correa et al.

(10) Patent No.: US 6,279,339 B1
(45) Date of Patent: Aug. 28, 2001

(54) SNAP-IN PLASTIC GRILLE FOR AN AIR CONDITIONER HOUSING

(75) Inventors: Juan C. C. Correa, Porto Alegre (BR); Nestor Hernandez, Nuevo Leon (MX); Peter R. Bushnell, Cazenovia, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/641,232

(22) Filed: Aug. 17, 2000

(51) Int. Cl.[7] ..... F25D 23/12

(52) U.S. Cl. ..... 62/262; 62/298

(58) Field of Search ..... 62/262, 298; 312/236

(56) References Cited

U.S. PATENT DOCUMENTS

| | | | | |
|---|---|---|---|---|
| 2,945,358 | * | 7/1960 | MacLeod et al. | 62/262 |
| 2,945,360 | * | 7/1960 | Tyler | 62/262 |
| 5,315,842 | * | 5/1994 | Bolton et al. | 62/262 |
| 5,775,119 | * | 7/1998 | Yamada et al. | 62/259.1 |
| 5,971,505 | | 10/1999 | Zamora | 312/213 |

* cited by examiner

*Primary Examiner*—William Doerrler

(57) ABSTRACT

An air conditioning unit is provided, which includes an outdoor section which has a condenser coil mounted therein and an outer protective housing at least partially enclosing the outdoor section. The housing has a substantially rectangular opening therein in overlying relation with the condenser coil. The opening is defined by four coplanar wall sections of given thickness. Each wall section has an edge thereof, which cooperates with the edges of the other wall sections to define the perimeter of the opening. A one-piece molded plastic grille is configured to substantially cover the opening. The grille includes an outer framework sized to be substantially contiguous with the perimeter of the rectangular opening. The outer framework is defined by upper, lower and left and right frame members, which are interconnected at the ends thereof to define the outer framework. A plurality of inclined horizontal louvers extend between the left and right frame members. Grille positioning and retaining structure are integrally formed with each of the frame members. Each of the positioning and retaining structures includes a first portion extending outwardly from its respective frame member in overlying relationship with one of the coplanar wall sections, and a second portion extending outwardly from its respective frame member in underlying relation with its associated coplanar wall section. The first and second portions are spaced from one another by a distance equal to the given thickness of the coplanar walls to define a space therebetween configured to receive the edge of and a portion of the coplanar wall therein. The plastic grille is sufficiently flexible to allow it to be deformed to a condition to allow each of the grille positioning and retaining structures to engage their respective coplanar wall sections and to thereafter to return to an undeformed condition when assembled to the housing.

5 Claims, 6 Drawing Sheets

FIG.1

FIG.2

SNAP-IN PLASTIC GRILLE FOR AN AIR CONDITIONER HOUSING

BACKGROUND OF THE INVENTION

The present invention is directed to air conditioners and, more particularly, to a protective grille for the condenser coil of an air conditioner.

Air conditioning units such as so called "window room air conditioners" are commonly used for residential and similar applications and generally include closed refrigeration circuits having an evaporator and a condenser. The unit is normally divided by a partition into an evaporator section and a condenser section. The evaporator section communicates with the room air to be conditioned and the condenser section communicates with external air such as outdoor air. Refrigerant flows through a refrigerant circuit absorbing heat from room air at the evaporator and discharging heat energy to the external air at the condenser. The conventional refrigerated circuit is completed by the addition of a compressor, an expansion device and the appropriate interconnections between the components.

Such an air conditioning unit usually includes a basepan supporting all of the components and an outer housing surrounding the entire unit. The front of the evaporator, or indoor section, includes an indoor grille, which has openings therein for directing warm indoor air into the evaporator and discharge openings therein for directing air back into the room. The outdoor section of the housing includes a plurality of openings in the sides and top thereof, which serve as inlet openings for cooling air which flows into the outdoor section and outwardly therefrom after passing through the condenser coil, which is mounted vertically in the back of the outdoor section.

Because the condenser coil includes a multitude of fragile heat exchange fins thereon, protective louvers or a grille of some sort is commonly provided to overlie the back of the condenser coil to protect the fins from damage. It is common practice in larger air conditioning units for the back of the housing of the unit to be substantially open and for the protective grille to be formed from a plurality of perpendicularly extending wire segments, which are welded to wall sections forming the perimeter of the back of the housing. Such grilles must be welded to the housing prior to applying the finished paint coat to the housing.

U.S. Pat. No. 5,971,505, "Snap-in Grille For An Air Conditioner Housing", is assigned to the assignee of the present invention and relates to a flexible protective grille having spaced edges which include outward extensions, which are adapted to be received in conformations formed in the air conditioner housing. While the design of the '505 patent provides a simple snap-in installation, it still requires welding of the various components of the grille as well as metal forming of the conformations adapted to receive the attaching portions of the grille.

SUMMARY OF THE INVENTION

An air conditioning unit is provided, which includes an outdoor section which has a condenser coil mounted therein and an outer protective housing at least partially enclosing the outdoor section. The housing has a substantially rectangular opening therein in overlying relation with the condenser coil. The opening is defined by four coplanar wall sections of given thickness. Each wall section has an edge thereof, which cooperates with the edges of the other wall sections to define the perimeter of the opening. A one-piece molded plastic grille is configured to substantially cover the opening. The grille includes an outer framework sized to be substantially contiguous with the perimeter of the rectangular opening. The outer framework is defined by upper, lower and left and right frame members, which are interconnected at the ends thereof to define the outer framework. A plurality of inclined horizontal louvers extend between the left and right frame members. Grille positioning and retaining structure are integrally formed with each of the frame members. Each of the positioning and retaining structures includes a first portion extending outwardly from its respective frame member in overlying relationship with one of the coplanar wall sections, and a second portion extending outwardly from its respective frame member in underlying relation with its associated coplanar wall section. The first and second portions are spaced from one another by a distance equal to the given thickness of the coplanar walls to define a space therebetween configured to receive the edge of and a portion of the coplanar wall therein. The plastic grille is sufficiently flexible to allow it to be deformed to a condition to allow each of the grille positioning and retaining structures to engage their respective coplanar wall sections and to thereafter to return to an undeformed condition when assembled to the housing.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENTS

Figure 1:
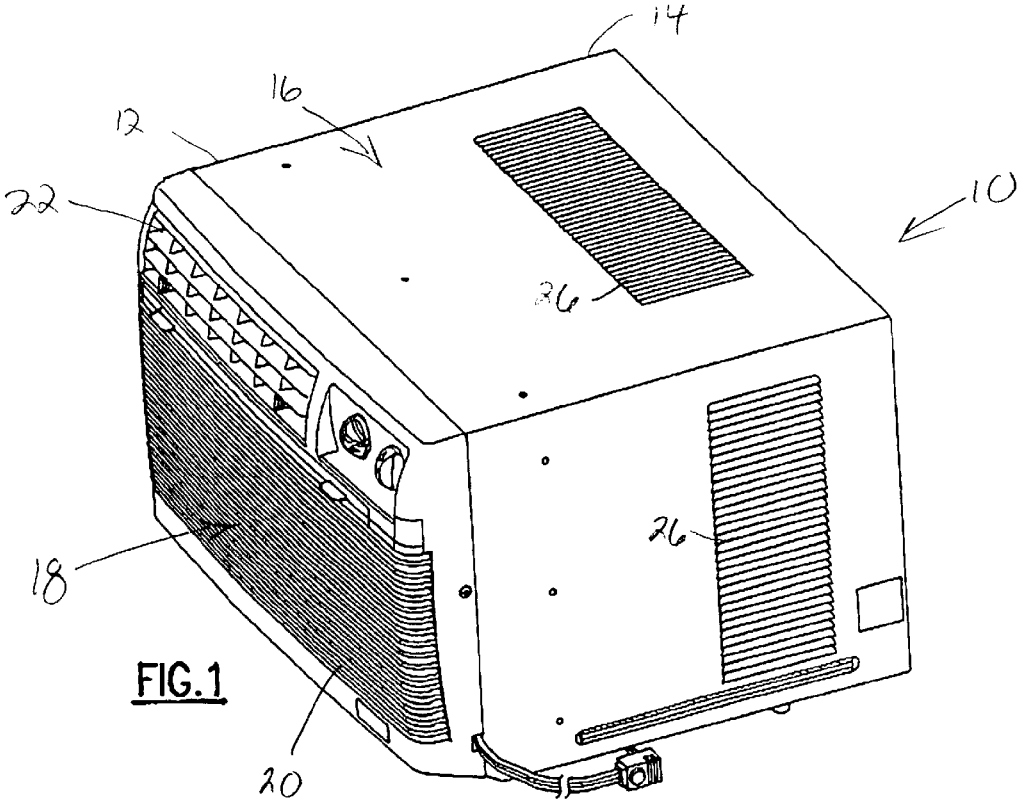
FIG. 1 is a front perspective view of a room air conditioner, which embodies the features of this invention.

FIG. 1 illustrates an air conditioning unit 10, which includes, generally, an indoor section 12 and an outdoor section 14. The room air conditioner is enclosed in a substantially rectangular housing 16 and is adapted to be positioned in a rectangular opening in an exterior wall or in a window in a room where cooling is desired, with the indoor section 12 facing into the room, as is conventional.

The indoor section 12 includes an indoor grille section 18, which includes inlet louvers 20 and an air discharge assembly 22. During operation of the air conditioner, air from the space to be conditioned by the unit is drawn by action of an evaporator fan (not shown) through the inlet louvers 20 and is directed through an evaporator coil (not shown) where the air is cooled. The cooled air is then directed back into the room to be cooled through the air discharge assembly 22.

The air conditioning unit 10 also includes, as is conventional, an outdoor refrigerant to air heat exchanger 24 or, coil, hereinafter "condenser coil 24". The condenser coil 24 is fluidly interconnected with a compressor (not shown) and the unit evaporator in a conventional manner to provide cooling to the room in which the unit is installed. In operation, ambient air enters the housing 16 through a plurality of louvered air inlets 26 located in the tops and sides in the housing 16. Ambient air is drawn through the inlets 26 by operation of an outdoor fan (not shown) and is directed through the condenser coil 24 before exiting from the back side 28 of the condenser coil and through a large rectangular opening 30 in the housing 16, which is in overlying relationship with the back side 28 of the condenser coil 24.

Figure 2:
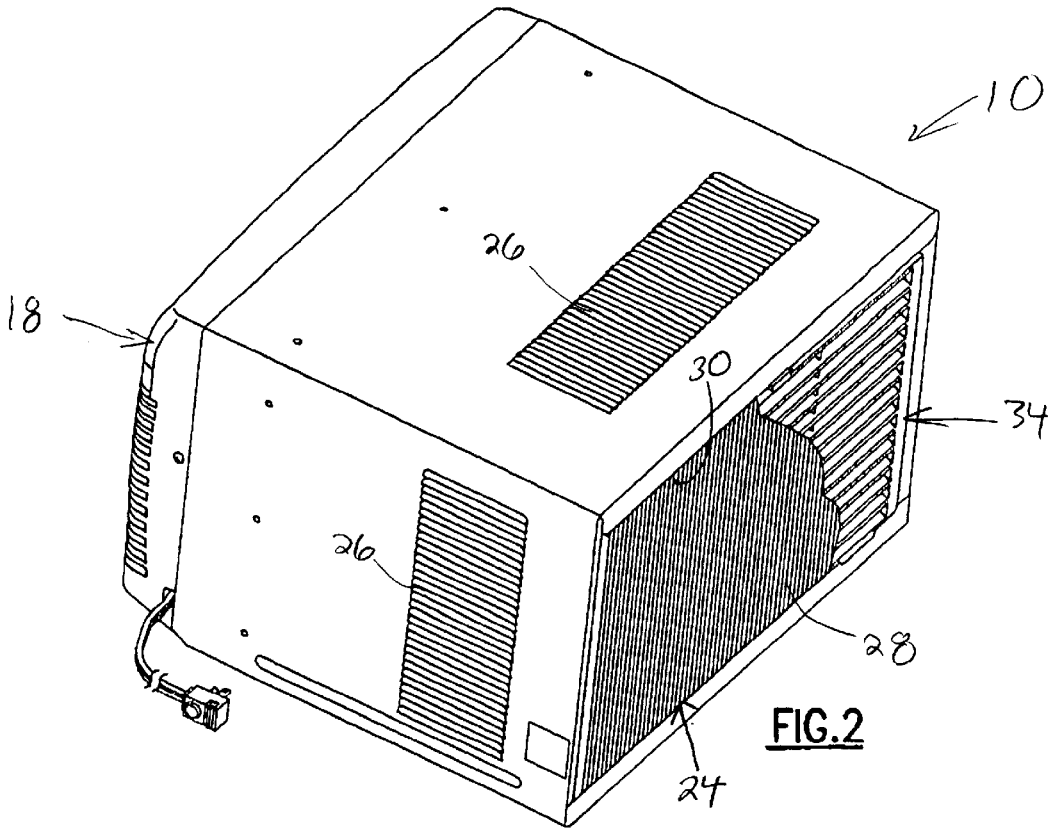
FIG. 2 is a rear perspective view partially broken away of the air conditioner illustrated in FIG. 1.
Figure 3:
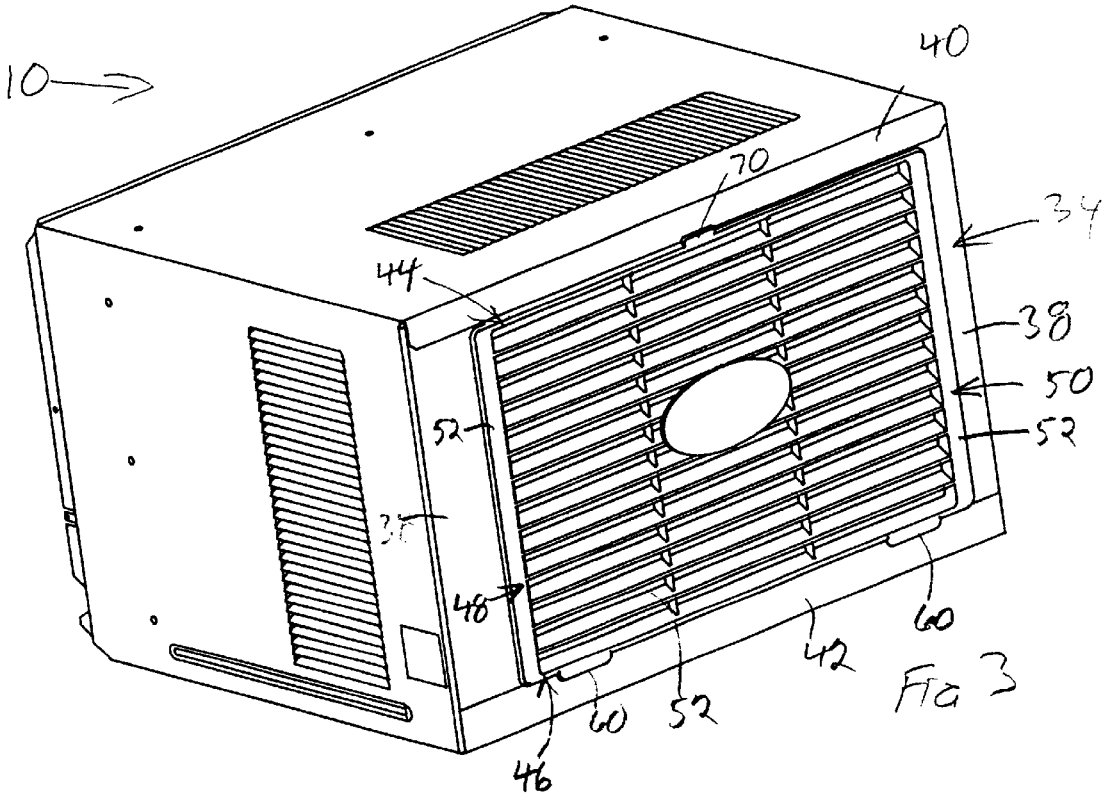
FIG. 3 is a rear perspective view of the housing of a room air conditioner of the type illustrated in FIG. 1 with the rear grille installed.
Figure 4:
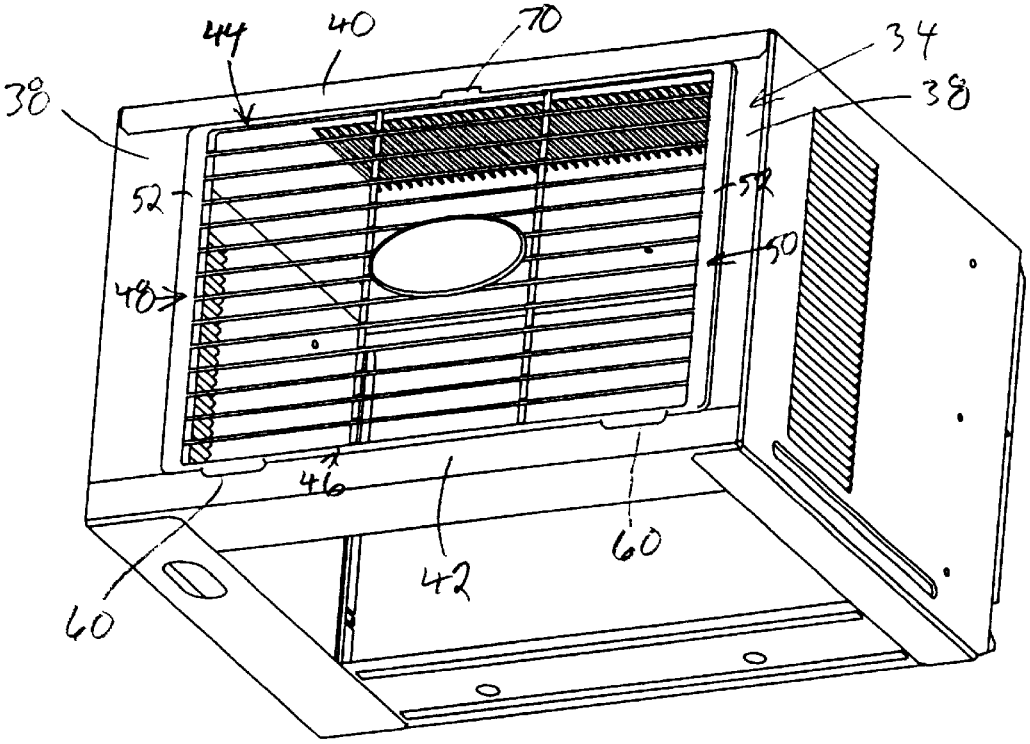
FIG. 4 is a perspective view of the housing illustrated in FIG. 3 taken from the rear lower side thereof.

As is best seen in FIG. 2, the back side 28 of the condenser coil 24 is defined by a plurality of vertically extending heat exchange fins, which serve to facilitate heat transfer from the hot refrigerant running through the coil 28 to the air flowing therethrough. The fins are extremely fragile and are protected by an overlying rectangularly-shaped protective grille 34. As will now be described in detail, the grille 34 is a one-piece molded plastic grille, which may be attached to the housing 16 without requiring any supplementary attachment hardware.

In the preferred embodiment, the housing 16 is formed from prepainted sheet steel material having a relatively thin predetermined thickness. The rectangular opening 30 overlying the condenser coil is defined by a pair of vertically extending, spaced, parallel coplanar wall sections 38 on the left and right-hand sides thereof, as viewed from the rear of the unit (i.e. FIGS. 2, 3, 4, 7 and 8). The top and bottom of the opening are defined by a pair of horizontally extending coplanar wall sections 40 and 42, respectively.

The protective grille 34 is a one-piece molded plastic component configured to substantially cover the rectangular opening 30. The grille includes an outer framework defined by an upper frame member 44, a lower frame member 46 and left and right frame members 48 and 50, respectively. The upper, lower and left and right frame members are interconnected at the ends thereof to define the outer framework of the grille. Integrally formed with and extending horizontally between the left and right frame members 48 and 50 are a plurality of angularly disposed louver elements 52.

Associated with each of the upper, lower and left and right frame members is a grille positioning and retaining structure, which is integrally formed with the frame members. The upper and lower arrangements are different, while the left and right are identical mirror images of one another. Each of the grille positioning and retaining structures has a first portion, which extends outwardly from its respective frame member and is in overlying relationship with a coplanar wall section of the housing. Further, each positioning and retaining structure has a second portion, which extends outwardly from its respective frame member and which is in underlying relationship with the coplanar wall section, with which it is associated. The first and second portions are spaced from one another by a distance substantially equal to the given thickness of the coplanar walls of the housing to define a space therebetween, which is configured to receive their associated edge and a portion of the coplanar wall therein. The plastic grille is sufficiently flexible to allow the grille to be deformed to a condition to allow each of the grille positioning and retaining structures to engage their respective coplanar wall sections and to thereafter return to an undeformed condition when assembled to the housing.

Figure 10:
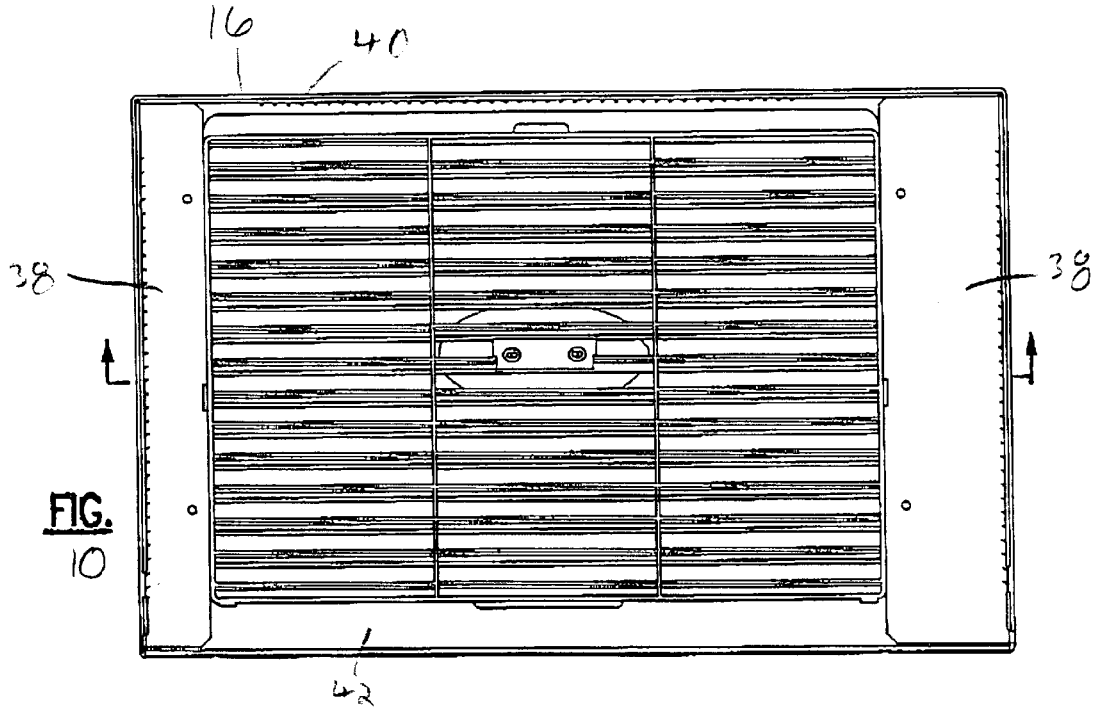
FIG. 10 is a front view of the housing illustrated in FIG. 3.
Figure 11:
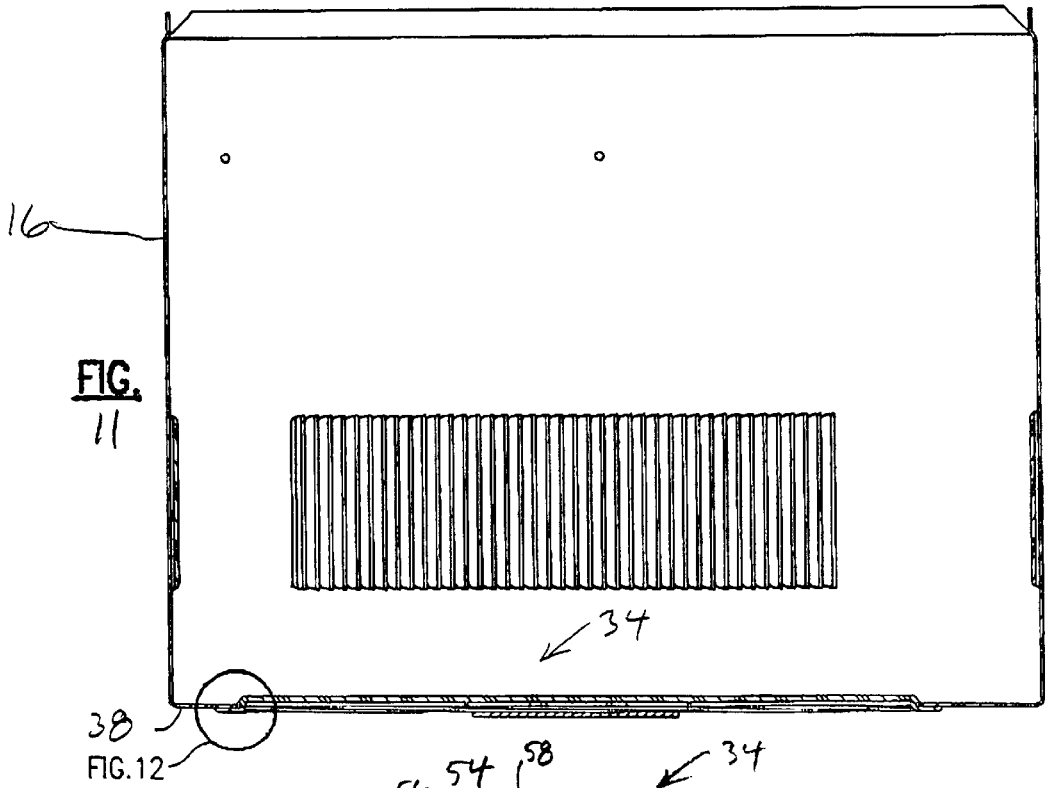
FIG. 11 is a view taken along the line 11—11 of FIG. 10.
Figure 12:
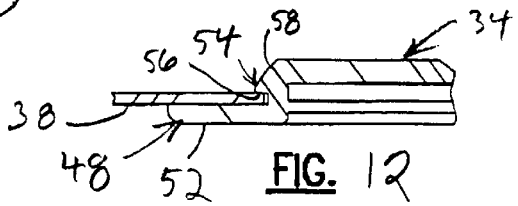
FIG. 12 is an enlarged view of the area identified as FIG. 12 in FIG. 11.

Looking first at the left and right frame members 48 and 50, the first portion of the grille positioning and restraining structure of each of these members comprises a planar wall 52 extending substantially the entire the length of each of the frame members. The second portion, 54, as best seen in FIGS. 10–12 is a short angled wall section presenting a planar surface 56 in confronting relation with the back of the planar wall 38 and an inclined surface 58 which facilitates passage of the planar wall past the edges of the side walls 38 during installation of the grille.

Figure 5:
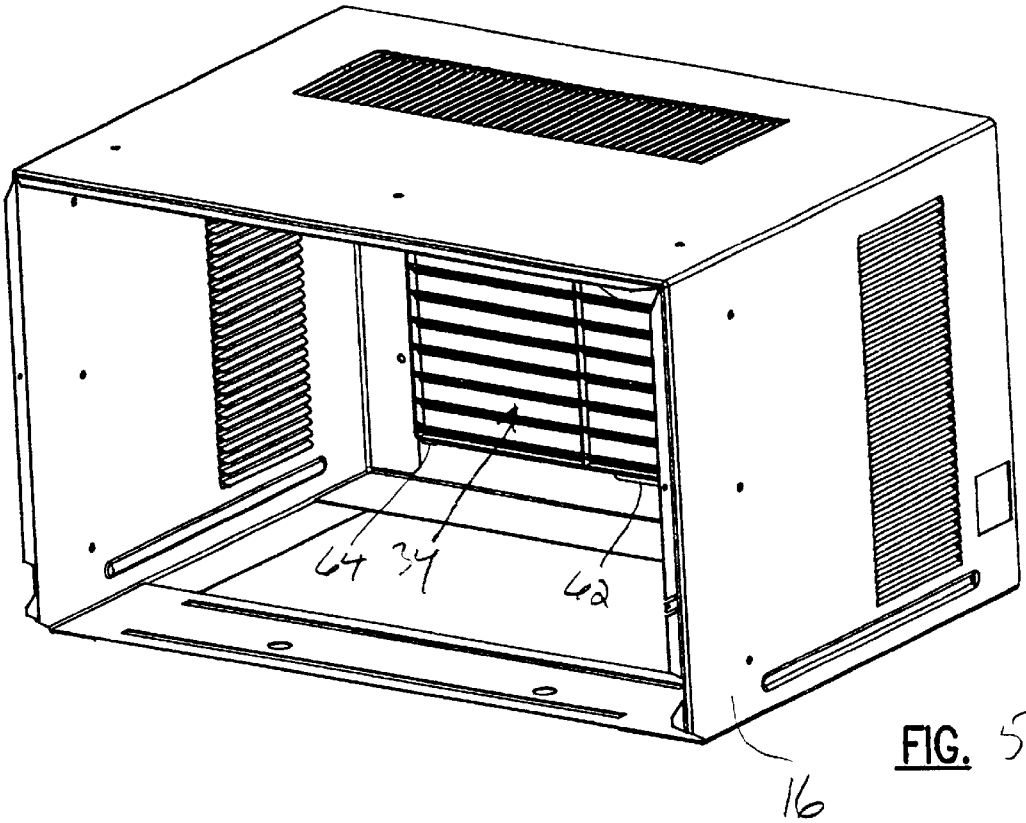
FIG. 5 is a view of the housing illustrated in FIG. 3 taken from the top upper front thereof.
Figure 6:
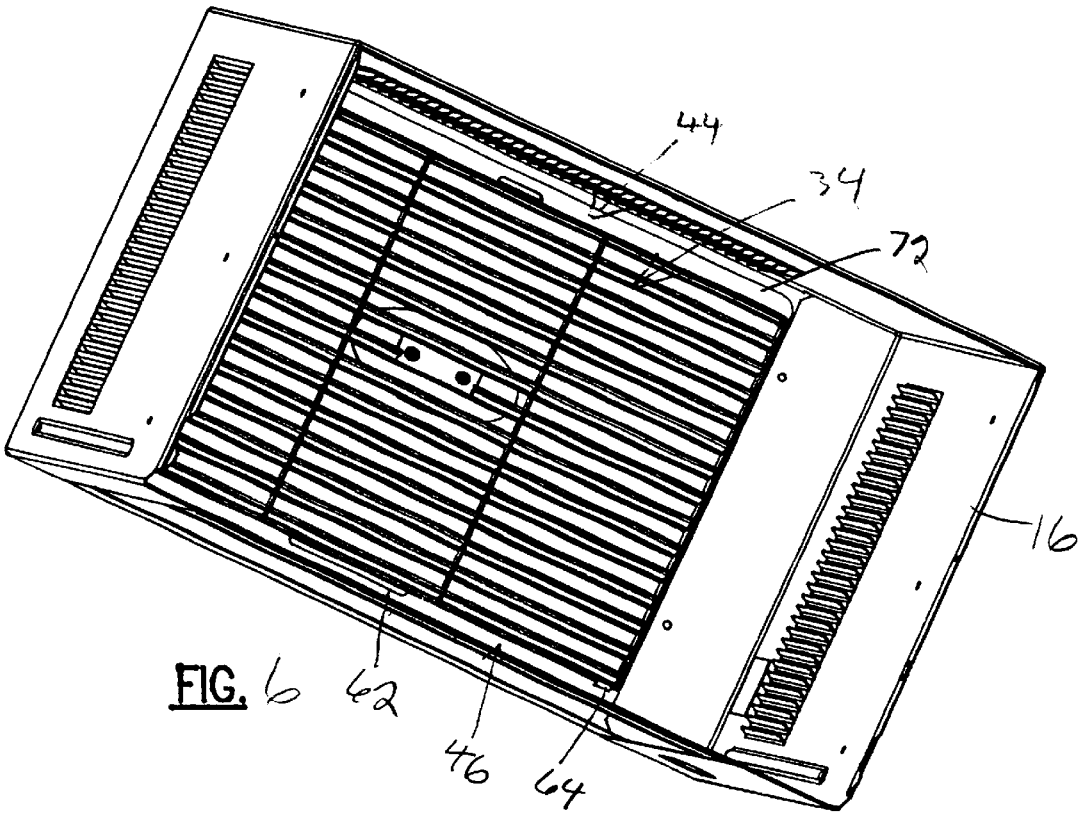
FIG. 6 is a view similar to FIG. 5 taken from the left side thereof.
Figure 9:
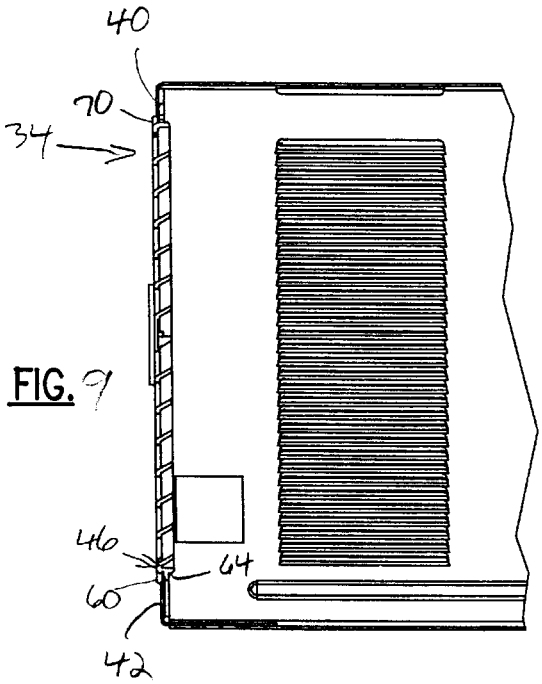
FIG. 9 is a view taken along the lines 9—9 of FIG. 8.

Looking now at the lower frame member 46, the first portion of the grille positioning and retaining structure comprises two discontinuous spaced apart planar wall sections 60. As best seen in FIGS. 5, 6 and 9, the second portion of the positioning and retaining structure on the lower frame comprises an elongated centrally located wall section 62 and a pair of short retaining sections 64 similar to the sections 54 described above in connection with the side frame members. As with the elements 54, the two elements 64 are provided with a planar surface and an inclined surface facilitating and retaining installation of the lower frame member to the housing.

Figure 7:
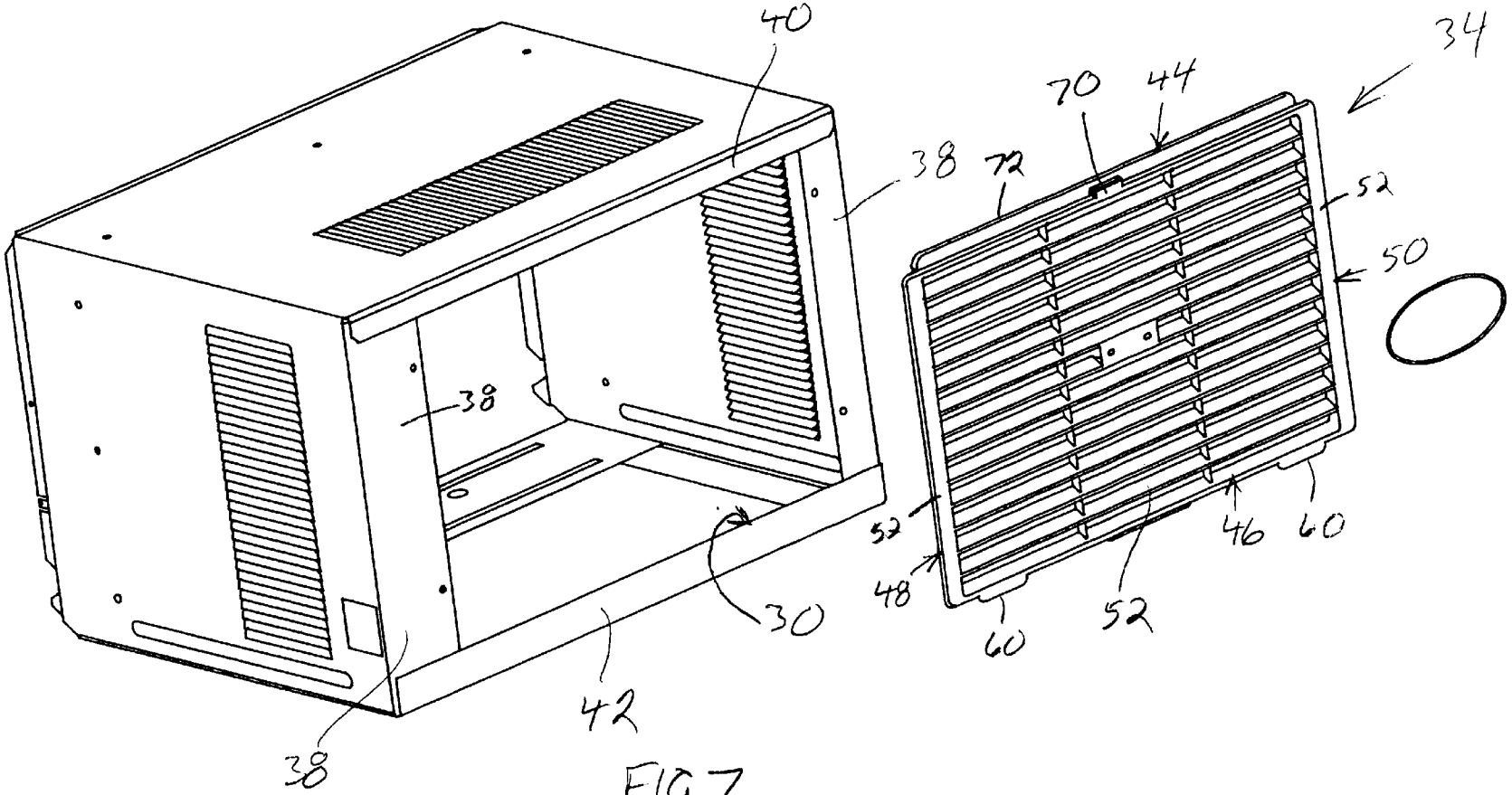
FIG. 7 is a view similar to FIG. 3 with the grille removed from the housing.
Figure 8:
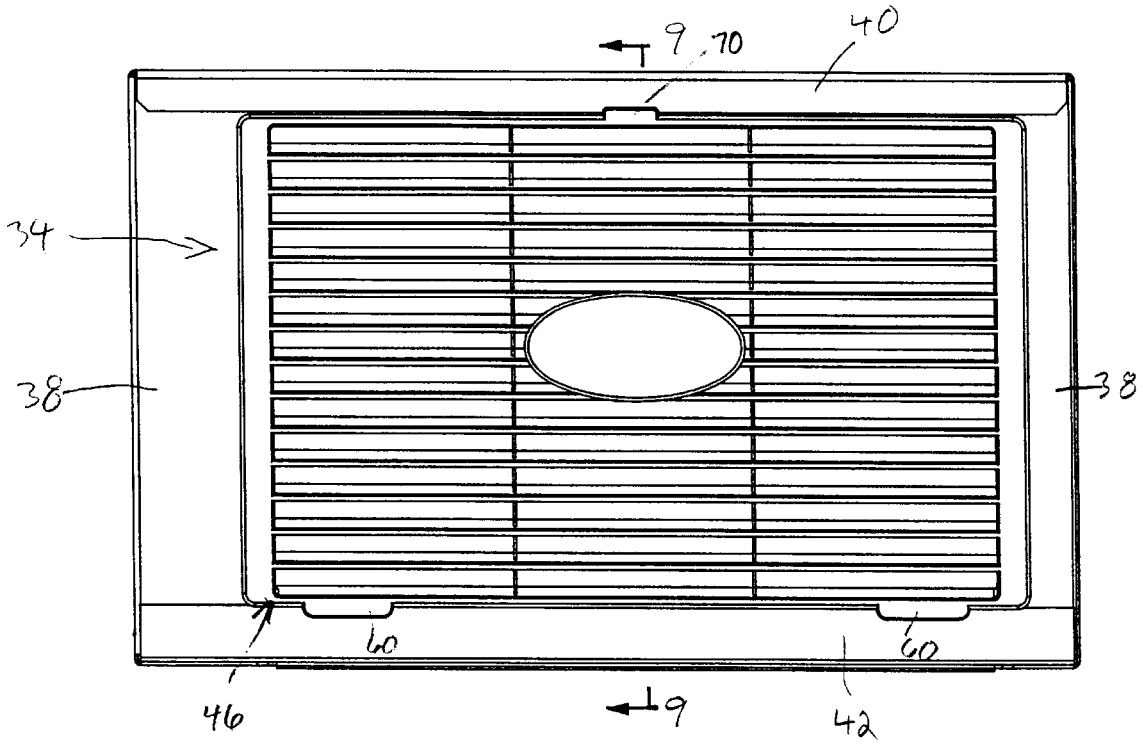
FIG. 8 is a rear view of the housing illustrated in FIG. 3.

As best seen in FIG. 7, the first portion of the grille positioning and retaining structure of the upper frame 44 includes a relatively short vertically extending planar wall section 70, while the second portion comprises a vertically and longitudinally extending wall 72 which extends for substantially the full width of the rectangular opening 30.

Installation of the grille 34 to the housing is accomplished by first inserting the long wall 72 of the upper frame 44 behind the top wall 40 of the opening 30 with the wall 40 extending into the space defined between the longitudinal wall 72 and the short wall section 70. Following this, the grille is flexed so that the central section 62 and the end sections 64 of the lower frame 46 are received behind the bottom wall section 42 of the lower frame. Installation is completed by pressing on the outer planar walls 48 and 50 of the left and right-hand frames, which cause the short wall sections 54 to snap into engagement behind the left and right side walls 38 to thereby affix the grille 34 to the housing 16.

What is claimed is:

1. An air conditioner of the type having an outdoor section, which has a condenser coil mounted therein and an outer protective housing at least partially enclosing the outdoor section, wherein the improvement comprises:

said housing having a substantially rectangular opening therein in overlying relation with the condenser coil, said opening being defined by four coplanar wall sections of a given thickness, each wall section having an edge thereof, which cooperates with the edges of the other wall sections to define the perimeter of said rectangular opening;

a one-piece molded plastic grille configured to substantially cover said rectangular opening, said grille comprising:

an outer framework sized to be substantially contiguous with said perimeter of said rectangular opening, said outer framework being defined by an upper frame member, a lower frame member and left and right frame members, said frame members being interconnected at the ends thereof to define said outer framework;

a plurality of inclined horizontal elements extending between said left and right frame members;

grille positioning and retaining structure integrally formed with each of said upper, lower, left and right frame members, each of said positioning and retaining structures including a first portion extending outwardly from its respective frame member in overlying relationship with one of said coplanar wall sections, and a second portion extending outwardly from its respective frame member in underlying relationship with said one coplanar wall section, said first and second portions being spaced from one another by a distance substantially equal to said given thickness of said coplanar walls to define a space therebetween configured to receive said edge of and a portion of said coplanar wall therein;

said plastic grille being sufficiently flexible to allow said grille to be deformed to a condition to allow each of said grille positioning and retaining structures to engage their respective coplanar wall sections and to thereafter return to an undeformed condition when assembled to said housing.

2. The air conditioner of claim 1 wherein said first portion of said grille positioning and retaining structure of each of said left and right frame members comprises a planar wall extending substantially the entire length of each of said left and right frame members.

3. The air conditioner of claim 2 wherein said second portion of said grille positioning and retaining structure of said upper frame member comprises a planar wall extending substantially the entire length of said upper frame member.

4. The air conditioner of claim 1 wherein said first portion of said grille positioning and retaining structure of said lower frame member comprises two or more discontinuous, spaced apart planar wall sections.

5. The air conditioner of claim 4 wherein said second portion of said grille positioning and retaining structure of said lower frame member comprises a plurality of spaced apart discontinuous downwardly extending protrusions.

* * * * *